United States Patent [19]

Schmidt et al.

[11] 3,935,939

[45] Feb. 3, 1976

[54] AUTOMATIC THREADING OF A TYPING RIBBON

[75] Inventors: Uwe Schmidt; Kurt Chvatlinsky, both of Wilhelmshaven, Germany

[73] Assignee: Olympia Werke AG, Wilhelmshaven, Germany

[22] Filed: Feb. 25, 1974

[21] Appl. No.: 445,146

[30] Foreign Application Priority Data

Feb. 23, 1973 Germany ..... 2309017

[52] U.S. Cl. ..... 197/175

[51] Int. Cl.[2] ..... B41J 33/14; B65H 75/28

[58] Field of Search ..... 197/151, 172, 175; 242/74, 242/74.1, 74.2, 125, 125.1, 125.2, 125.3; 226/91, 92

[56] References Cited

UNITED STATES PATENTS

| | | | |
|---|---|---|---|
| 366,073 | 7/1887 | Cate | 242/125 X |
| 2,536,126 | 1/1951 | Dale | 242/125.2 |
| 2,757,451 | 8/1956 | Johnson | 242/125.2 UX |
| 2,973,126 | 2/1961 | Kresslein | 242/125 X |
| 3,214,108 | 10/1965 | Louzil | 242/74 X |
| 3,241,783 | 3/1966 | Laa | 242/74 |
| 3,314,624 | 4/1967 | Louzil et al. | 226/91 X |
| 3,612,242 | 10/1971 | Cassell et al. | 197/151 |
| 3,782,651 | 1/1974 | Hengelhaupt et al. | 242/74 |

FOREIGN PATENTS OR APPLICATIONS

| | | | |
|---|---|---|---|
| 1,112,978 | 11/1955 | France | 242/74 |

*Primary Examiner*—J. Reed Fisher
*Attorney, Agent, or Firm*—Spencer & Kaye

[57] ABSTRACT

A holding device for temporarily holding the free end of a typing or printing ribbon to permit it to be automatically wound around the core of a takeup reel in an automatic ribbon fastening system. The reel has one flange part provided with a threading slit whose width increases toward the outer edge of the flange part from an inwardly located ribbon-gripping portion. The holding device temporarily holds the free end stationary under slight tension so that the ribbon extends across the flange part. As the reel is rotated, the ribbon enters the threading slit and slides radially inwardly until it is gripped by the gripping portion. As the reel continues to rotate, the free end of the ribbon is pulled out of the holding device.

7 Claims, 4 Drawing Figures

AUTOMATIC THREADING OF A TYPING RIBBON

BACKGROUND OF THE INVENTION

The present invention relates to the feeding of typing ribbons in typewriters and similar office machines, and particularly to the feeding of such ribbons onto the takeup reel of such machines.

During operation of a machine of the type indicated above, a carbon ribbon is drawn from a supply reel, passed one time through the printing station, and wound onto a takeup reel. Thus the ribbon must be exchanged relatively frequently. In this connection it is desirable to effect the exchange of ribbons simply, quickly and without soiling the fingers, if possible.

Threading and fastening of the leading end of such ribbon to the takeup reel in known devices, for example as disclosed in Austrian Pat. No. 233,033, still requires considerable handling, which does not pose any significant difficulties to a user who is skilled in this respect. Nevertheless, the process is complicated enough that the machine must be shut off. The ribbon is here manually fastened to the core of the reel. This threading of the ribbon is thus rather cumbersome and soiling of the operator's fingers is likely.

German Auslegeschrift (Published Application) No. 2,002,703 discloses an apparatus for threading and fastening the carbon ribbon to the core of a takeup reel in which the ribbon is automatically pulled into a threading slit by a catching edge. In this case it is necessary to hold the ribbon during at least two revolutions of the reel. This threading also requires a certain dexterity on the part of the machine operator.

SUMMARY OF THE INVENTION

It is therefore an object of the present invention to avoid the above-noted drawbacks and to enable a single revolution of the takeup reel to effect automatic and dependable threading of the ribbon.

These and other objects according to the invention are achieved by the provision, in an automatic ribbon fastening system, of a holding device for resiliently holding the free end of such a ribbon to facilitate automatic fastening of such free end around the core of a takeup reel. The holding device is constructed to cooperate with a takeup reel of the type having two flange parts adjacent respective axial ends of the core. The system includes a guide member from which the ribbon is guided transversely across the edge of one of the reel flange parts for threading. This one flange part is formed to have a threading slit which increases in width in the direction from the reel core to the outer edge of the flange part, with the trailing edge of the slit, with respect to the direction of reel rotation, being inclined radially outwardly in the direction of rotation of the reel to constitute a catching edge along which the ribbon moves, as the reel rotates, to be gripped in the slit and wound around the reel core. The holding device is arranged to hold the free end of the ribbon under tension in an orientation such that the ribbon extends approximately diametrically across the one reel flange part, whereby upon rotation of the reel the ribbon is engaged by the catching edge of the threading slit and is pulled into the narrow end of the slit and out of the holding device.

The particular advantage of the present invention is that threading of the ribbon into the threading slit takes place automatically and no specially prepared ribbon ends are required, as is the case, for example, for the ribbon of German Auslegeschrift (Published Application) No. 1,193,711.

Trapping of the ribbon end is made even more dependable by imparting a wedge shape to the end of the threading slit which faces the core of the takeup reel.

The embodiment of the invention in which the holding device includes a resilient sheet metal part having a contact surface bearing against the case in which the takeup reel is disposed offers the advantage that the ribbon ends which protrude from the threading slit and through a recess in the case always have the same length. In contrast, in the invention arrangements disclosed in German Auslegeschrift No. 2,002,703 it is possible for the ribbon ends to become too long so that rotation of the takeup reel is impeded.

The present invention overall is distinguished by a simple and dependable configuration.

DESCRIPTION OF THE PREFERRED EMBODIMENTS

Figure 1:
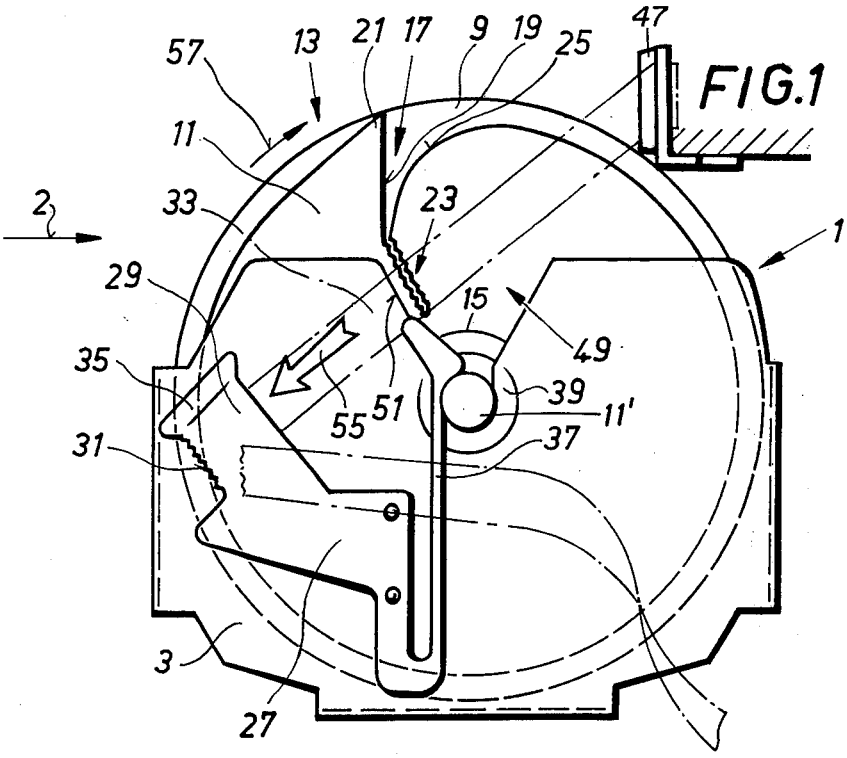
FIG. 1 is a side elevational view of a preferred embodiment of the invention and shows the outer flange portion of the takeup reel and the outer side portion of its case.
Figure 2:
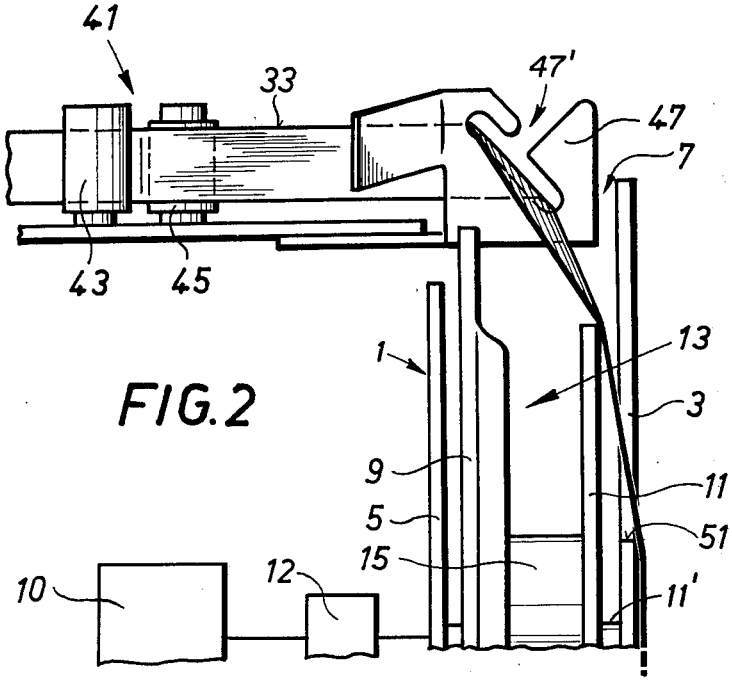
FIG. 2 is a detail taken in the direction of arrow 2 of FIG. 1, FIG. 2 being to a larger scale than FIG. 1.

The apparatus shown in FIGS. 1 and 2 includes a case 1 fastened to the left side wall (not shown) of a typewriter or similar office machine. The case 1 includes substantially two side portions 3 and 5 defining between them a ribbon receiving opening 7. Within case 1 a takeup reel 13, which includes two flange portions 9 and 11, is rotatably mounted and is driven by a friction coupling, e.g. a slip clutch, 12 and a motor 10. The right-hand flange portion 11 of the takeup reel 13, as viewed in the plane of FIG. 2, is provided with a threading slit 17 which becomes progressively wider from the region of reel core 15 to the outer periphery of flange part 11. Slit 17 is defined in part by a catching, or trapping, edge 19 which extends obliquely to the direction of rotation 57 of the takeup reel 13. More specifically, considered relative to a radial direction from the axis of rotation of reel 13, edge 19 is inclined in the direction of rotation 57. The outer end 21 of this catching edge 19 protrudes beyond the outer periphery of flange part 11.

The outer diameter of the left-hand flange part 9 in the illustrated embodiment is larger than the diameter of the right-hand flange part 11, but both diameters may also by the same.

The inner end 23 of threading slit 17 which faces the reel core 15 is designed as a wedge-shaped blade. This blade is provided with serrations, which may be teeth or ribs 16, 18, in order to facilitate gripping the ribbon end.

The inner end 23 of the threading slit 17 is tapered in the shape of a wedge and is radially directed to the reel core 15.

Figure 1A:
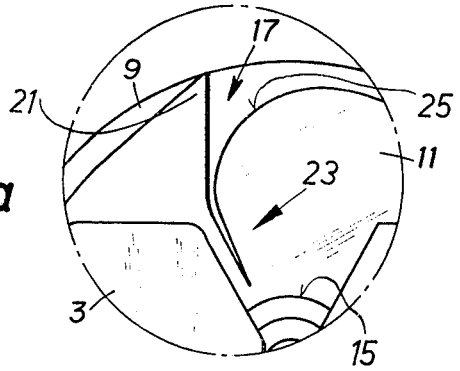
FIG. 1*a* is a detail of the inner end of the threading slit in the form of a wedge-shaped blade.

The tapered end 23 of the threading slit 17 is smaller than the thickness of the ribbon 33, FIG. 1*a*.

Figure 1B:
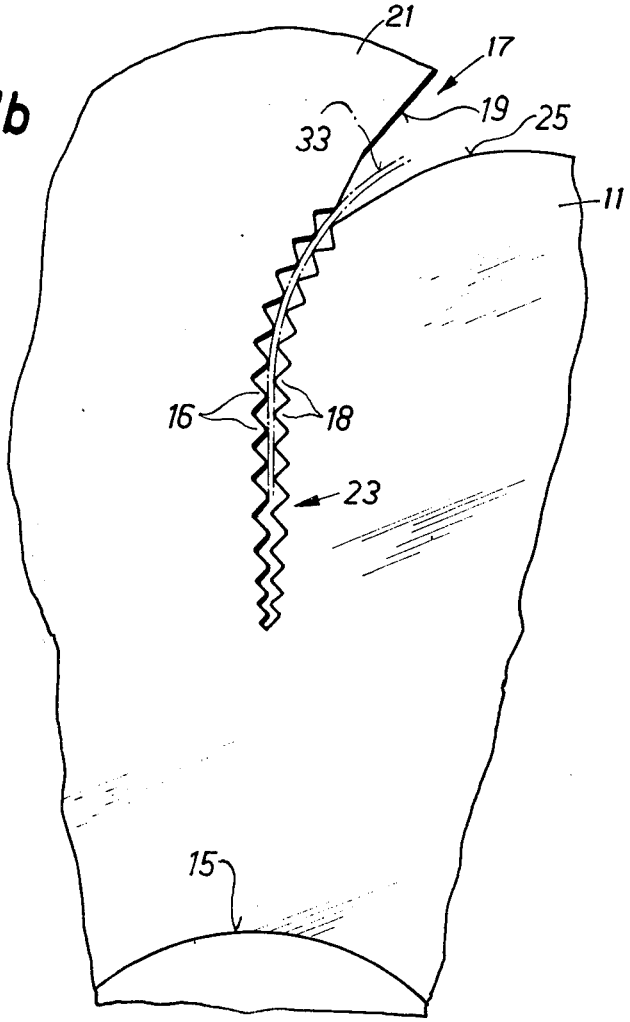
FIG. 1*b* is a detail of the inner end of the threading slit in the form with serrations.

The tapered end 23 of the threading slit 17 in FIG. 1 and FIG. 1*a* is provided with serrations, to perform a better suitable gripping function. The distance between the teeth 16 and 18 at the inner end 23 is smaller than the thickness of the ribbon 33, FIG. 1*b*.

The surface 25 defining the side of the catching slit 17 which faces the catching edge 19 is given a large intake radius. This large intake radius of the surface 25 provides for a suitable gripping and gliding of the ribbon 33 to the inner end 23 of the threading slit 17.

At the outer side portion 3 of case 1 a holding device is fastened. This device includes a resilient sheet metal part 27 which can be riveted to portion 3, for example, and whose contact surface 29 normally rests against the outer surface of side portion 3 of case 1 under light tension. This resilient sheet metal part 27 also has a toothed edge 31 along which the ribbon 33 can be torn off. In order to bring ribbon 33 more easily under the contact surface 29, a portion 35 sloped away from portion 3 is provided at the end of sheet metal part 27. With the aid of a further resilient arm 37 of sheet metal part 27 the takeup reel 13 is simultaneously locked in a mounting recess 39 in case 1, reel flange portion 11 preferably being provided with an axial pivot pin 11 having a flanged outer end to permit secure locking by arm 37.

Ribbon 33 is known to be brought from a supply reel (not shown) past the printing station to a switchable drive 41 composed of a driven drive wheel 43 and a spring-biased pressure roller 45. Drive 41 transports the ribbon 33, through a guide member 47 and a recess 49 in the outer side portion 3 of the case 1, toward the holding device 27.

In the operation of the described device, once the supply reel then in use has become empty, the filled takeup reel 13 is taken out of case 1 and is discarded together with the used ribbon 33. The empty supply reel which in systems employing the invention, has exactly the same configuration as the takeup reel 13, is now used as the new takeup reel 13 and inserted into case 1. The free end of the ribbon 33 on a new full supply reel is inserted between pressure roller 45 and drive wheel 43 of the switchable drive 41, threaded through the illustrated slit 47' in guide member 47 and then through recess 49 and along the outer surface of side portion 3 of case 1.

Now the ribbon 33, which is being held by drive 41, is pushed or slid sideways under the contact surface 29 of the resilient sheet metal part 27 to be gripped between surface 29 and the outer surface of casing portion 3. Then the ribbon 33 is pulled in the direction of arrow 55 and the protruding end is torn off across toothed edge 31. This imparts a slight tension to the length of ribbon 33 between drive 41 and the contact surface 29 so that the ribbon 33 lightly contacts the edge of the right-hand flange part 11 of the takeup reel 13 and the edge 51 of casing portion 3 at recess 49.

If the takeup reel 13, which is driven by slip clutch 12, is rotated in the direction of rotation 57, the catching edge 19, 21 of threading slit 17 will catch the ribbon 33 and automatically pull it into the wedge-shaped trapping or gripping edge of threading slit 17. This catching of the ribbon 33 is made possible by the short-term resilient gripping of the ribbon 33 by the contact surface 29 of sheet metal part 27 and by the ribbing in region 23 of threading slit 17. The ribbon 33 is then automatically wound onto the core 15 of the takeup reel 13. The ribbon 33, which is released during each printing process by drive 41, is then automatically wound onto the takeup reel 13 which is in continuous communication with slip clutch 12. The guide edge 51 at the outer side part 3 of case 1 prevents deflection of the ribbon 33 toward the side after it has been released by the resilient sheet metal part 27.

The automatic fastening device has been described in connection with a carbon ribbon device for a typewriter or a similar office machine; it is a matter of course that the device can be used for any instrument where the necessity exists to wind material onto a reel and to fasten it thereto quickly and without special skill.

It will be understood that the above description of the present invention is susceptible to various modifications, changes and adaptations, and the same are intended to be comprehended within the meaning and range of equivalents of the appended claims.

We claim:

1. In a system for the automatic fastening of the free end of a ribbon to the core of a takeup reel in an office machine in which such reel is driven by a friction coupling, the reel including two flange parts enclosing the core, and the system including a guide member from which the ribbon is guided transversely across the edge of one of the two flange parts of the takeup reel in order to thread the ribbon, the one flange part being provided with a threading slit which increases in width in the direction from the reel core to the outer edge of the one flange part, with one side of said slit being defined by a catching edge inclined obliquely to the direction of rotation of the reel, rotation of the reel causing the ribbon to be gripped through the slit, carried along by the reel and wound around the reel core, the improvement wherein said one flange part is formed such that the end of said threading slit which is adjacent said reel core is tapered in the shape of a wedge which narrows toward said reel core and is provided with serrations for gripping a ribbon inserted in said tapered end, and said system further comprises: a case for holding said reel and having two side parts each disposed to be adjacent a respective reel flange part; and a holding device composed of a resilient sheet metal part presenting a contact surface which presses against the outer surface of that side part of said case which is adjacent the one flange part for resiliently holding the free end of the ribbon, in a clamping manner, under tension between said sheet metal part and said outer surface of that side part adjacent the one flange part, in a position such that the ribbon extends approximately diametrically across said one flange part provided with the threading slit, whereby upon rotation of the takeup reel the ribbon is engaged by the catching edge and pulled out of said holding device into said threading slit.

2. An arrangement as defined in claim 1 wherein the radially outermost end of said catching edge protrudes beyond the periphery of said one flange part and the side of said threading slit opposite said catching edge has a large intake radius.

3. An arrangement as defined in claim 1 wherein said resilient sheet metal part is provided, adjacent said contact surface, with a portion inclined away from the associated side part of said case for facilitating insertion of the ribbon between said contact surface and said associated side part.

4. An arrangement as defined in claim 1 wherein the system is part of an office machine having a slip clutch connected to impart rotational movement to the reel.

5. In a system for the automatic fastening of the free end of a ribbon to the core of a takeup reel in an office machine in which such reel is driven by a friction coupling, the reel including two flange parts enclosing the core, and the system including a guide member from which the ribbon is guided transversely across the edge of one of the two flange parts of the takeup reel in order to thread the ribbon, the one flange part being provided with a threading slit which increases in width in the direction from the reel core to the outer edge of the one flange part, with one side of said slit being defined by a catching edge inclined obliquely to the direction of rotation of the reel, rotation of the reel causing the ribbon to be gripped through the slit, carried along by the reel and wound around the reel core, the improvement comprising: a case for holding said reel and having two side parts each disposed to be adjacent a respective reel flange part; and a holding device composed of a resilient sheet metal part presenting a contact surface which presses against the outer surface of that side part of said case which is adjacent the one flange part for resiliently holding the free end of the ribbon, in a clamping manner, under tension between said sheet metal part and said outer surface of that side part adjacent the one flange part, in a position such that the ribbon extends approximately diametrically across said one flange part provided with the threading slit, whereby upon rotation of the takeup reel the ribbon is engaged by the catching edge and pulled out of said holding device into said threading slit, and wherein said reilient sheet metal part is provided with a toothed edge for tearing off the portion of the ribbon which extends beyond said reel.

6. An arrangement as defined in claim 5 wherein said one flange part is formed such that the end of said threading slit which is adjacent said reel core is tapered in the shape of a wedge which narrows toward said reel core.

7. An arrangement as defined in claim 6 wherein said tapered end of said threading slit is provided with serrations.

* * * * *